US006619168B2

(12) United States Patent
Alsten et al.

(10) Patent No.: US 6,619,168 B2
(45) Date of Patent: Sep. 16, 2003

(54) METHOD AND APPARATUS FOR AUTOMATIC PRECISION CUTTING OF GRAPHICS AREAS FROM SHEETS

(75) Inventors: Peter Alsten, Racine, WI (US); Geo Andersen, Aabyhoej (DK)

(73) Assignee: Mikkelsen Graphic Engineering, Lake Geneva, WI (US)

( * ) Notice: Subject to any disclaimer, the term of this patent is extended or adjusted under 35 U.S.C. 154(b) by 0 days.

(21) Appl. No.: 09/951,167

(22) Filed: Sep. 13, 2001

(65) Prior Publication Data

US 2003/0047045 A1 Mar. 13, 2003

Related U.S. Application Data

(63) Continuation-in-part of application No. 09/827,000, filed on Apr. 5, 2001.

(51) Int. Cl.[7] ..... B26D 5/00

(52) U.S. Cl. ..... 83/13; 83/39; 83/52; 83/75.5; 83/76.8; 83/364; 83/365; 83/368; 83/371; 83/940; 700/134; 700/171; 347/157

(58) Field of Search ..... 83/861, 862, 875, 83/879, 880, 881, 13, 22, 32, 34, 39, 52, 56, 72, 73, 74, 75, 365, 75.5, 366, 76.8, 76.9, 368, 371, 901, 936, 939, 940, 747, 364; 700/114, 134, 213, 167, 150, 171, 230, 135, 259; 400/621; 347/157

(56) References Cited

U.S. PATENT DOCUMENTS

| | | | |
|---|---|---|---|
| 3,242,573 | A | 3/1966 | Noel |
| 3,608,799 | A | 9/1971 | Edson |
| 3,803,960 | A | 4/1974 | Pearl et al. |
| 3,805,650 | A | 4/1974 | Pearl |
| 3,838,618 | A | 10/1974 | Eissfeldt et al. |
| 3,848,490 | A | 11/1974 | Arel |

(List continued on next page.)

*Primary Examiner*—Boyer D. Ashley
(74) *Attorney, Agent, or Firm*—Jansson, Shupe & Munger, Ltd.

(57) ABSTRACT

An improved method and apparatus for automatic cutting of graphics area(s) from a sheet of material which includes such graphics area(s), the graphics areas having a plurality of registration marks in predetermined positions with respect thereto and including a subset of the marks on no more than one side of the graphics area which are initial-position/orientation-determining marks. The method involves placing the sheet on a sheet-receiving surface, attempting to sense the subset in the field of view of a main sensor, and, when the subset is not in an expected location, automatically determining the coordinate region of the subset on the sheet-receiving surface and automatically repositioning the main sensor to the coordinate region such that the subset is within the field of view of the main sensor. Then the position and orientation of the sheet and approximate positions of the plurality of marks are determined based on sensing the subset, and thereafter their precise positions are sensed to guide cutting operations.

17 Claims, 6 Drawing Sheets

U.S. PATENT DOCUMENTS 3,855,887 A 12/1974 Pearl et al.
3,864,997 A 2/1975 Pearl et al.
4,071,899 A 1/1978 Holy
4,083,095 A 4/1978 Flaum et al.
4,380,944 A 4/1983 Gerber et al.
4,419,913 A 12/1983 Schutt et al.
4,494,435 A 1/1985 Lindsay
4,555,968 A * 12/1985 Raney et al. ..... 83/209
4,583,181 A * 4/1986 Gerber et al. ..... 250/559.46
4,680,083 A 7/1987 Kashiwaba
4,697,485 A 10/1987 Raney
4,704,927 A 11/1987 Hirosawa
4,721,058 A * 1/1988 Hayamizu et al. ..... 118/39
4,768,410 A * 9/1988 Wood ..... 235/489
4,827,140 A 5/1989 Mohan
4,882,961 A * 11/1989 Zabinski et al. ..... 83/177
4,901,359 A * 2/1990 Bruder ..... 235/462.01
4,941,183 A 7/1990 Bruder et al.
5,074,178 A 12/1991 Shetley et al.
5,201,351 A 4/1993 Hurdle, Jr.
5,212,647 A 5/1993 Raney et al.
5,258,917 A 11/1993 Bruder et al.
5,333,111 A * 7/1994 Chaiken et al. ..... 382/111
5,537,135 A 7/1996 Hevenor et al.
5,551,786 A 9/1996 Webster et al.
5,644,979 A 7/1997 Raney
5,727,433 A 3/1998 Pomerleau et al.
5,794,526 A * 8/1998 Raney ..... 100/229 R
5,838,569 A * 11/1998 Gane ..... 700/134
5,937,725 A * 8/1999 Kamijo et al. ..... 83/56
6,112,630 A 9/2000 Miura
6,192,777 B1 2/2001 Williams et al.
6,205,370 B1 3/2001 Blaimschein et al.

* cited by examiner

METHOD AND APPARATUS FOR AUTOMATIC PRECISION CUTTING OF GRAPHICS AREAS FROM SHEETS

RELATED APPLICATION

This is a continuation-in-part of co-pending patent application Ser. No. 09/827,000, filed Apr. 5, 2001, entitled "Improved Method and Apparatus for Precision Cutting of Graphics Areas from Sheets.

FIELD OF THE INVENTION

This invention is related generally to the field of cutting of graphics areas or the like from sheets for various purposes, and other narrow-path-processing with respect to graphics areas on sheets.

BACKGROUND OF THE INVENTION

The technical field involving the cutting of graphic areas from sheets, or otherwise doing narrow-path-processing with respect to graphics images on sheets, includes, for example, the face-cutting of laminate sheets to form decals. More specifically, a graphics image area on the face layer of a laminate needs to be cut away from the remainder of the face layer so that the graphics area (decal) can subsequently be pulled away from the backing layer of the laminate and be applied elsewhere as intended. Highly accurate face-layer cutting about the graphics is obviously highly desirable.

This is but one example in which highly accurate sheet cutting (or other processing) is desirable. In many other situations, highly accurate sheet cutting which is desired may not involve face-cutting, but through-cutting, in which the full thickness of the sheet is cut about a graphics area on the sheet. And in many situations, rather than highly accurate cutting, highly accurate scoring, creasing, line embossing or the like, in each case, of course, along a line the varying direction of which is determined by the shape of the graphics area. Together these types of operations on sheets with respect to graphics areas thereon are referred to herein for convenience as "narrow-path-processing." For convenience, the prior art problems and the invention herein which solves such problems will be discussed primarily with reference to sheet-cutting apparatus.

A method and associated apparatus which addresses many of the problems encountered in such processing of sheet material is the i-cut™ vision cutting system from Mikkelsen Graphic Engineering of Lake Geneva, Wis., and is the subject of U.S. patent application Ser. No. 09/678,594, filed on Oct. 4, 2000, and U.S. patent application Ser. No. 09/827,000, filed on Apr. 5, 2001.

The invention described in the first document is a method and apparatus for achieving highly improved accuracy in cutting around graphics areas in order to fully adjust for two-dimensional distortion in the sheets from which the graphics areas will be cut, including distortion of differing degrees in different directions on the sheet of material. The distortion may be from the printing process or from some other post-printing process such as material handling or during the cutting process itself. This invention also provides improved speed and accuracy in narrow-path-processing and greater efficiency of material usage.

The invention described in the second document is a method and apparatus for automatically and rapidly determining the position and orientation of a sheet of material on a work surface. When the placement of the sheet of material is not precisely controlled, the speed of the cutting or other narrow-path-processing system is often impaired because the system may require manual intervention to adjust the placement of the sheet of material so that the system can begin processing. Thus, the invention described in the second document provides further improved speed over the invention described in the first document.

In some cases, such as in the i-cut™ system from Mikkelsen Graphic Engineering, a flatbed plotter is used. These are devices having a positionally-controlled cutting implement above a flat work surface on which the sheet to be cut rests. The cutting implements are controlled based on controller-supplied instructions based on the X-Y coordinates necessary to achieve cutting along the intended path, such as about the graphics area.

Achieving greater speed and overall efficiencies in cutting or other narrow-path-processing is a continuing challenge encountered in the field of graphics image processing. One source of inefficiency is the length of time required by the system to begin the cutting process after the sheet of material on which graphics areas have been previously printed are placed on the work surface of the cutting apparatus, either manually or by automatic sheet-feeding equipment. In either of these set-up situations, the cutting apparatus must determine the position and orientation of the sheet on the work surface in order to proceed accurately with the cutting process. If the operator or automatic sheet-feeder places the sheet of material on the work surface such that it is outside of the area or region of alignment on the work surface which the cutting system expects to find the sheet, manual intervention may be necessary to adjust the placement of the sheet to within the required initial region in order for the process to continue beyond this initial set-up step. A further source of inefficiency is the time-consuming step which may be required to allow the system to determine the initial position and orientation of the sheet on the work surface.

Despite the significant advances represented by the i-cut™ system, further increases in efficiency (speed of operation) are highly desirable in automated cutting systems.

OBJECTS OF THE INVENTION

It is an object of this invention to provide an improved method and apparatus for precision cutting of graphics areas from sheets overcoming some of the problems and shortcomings of the prior art.

Another object of this invention is to provide an improved method and apparatus which increase the speed of cutting and other narrow-path-processing of sheet material.

Another object of this invention is to provide an improved method and apparatus which automate the cutting and other narrow-path-processing of sheet material as much as possible.

Another object of this invention is to provide a method and apparatus for reducing the time to determine sheet position and orientation in apparatus for precise cutting around graphics areas.

Still another object of this invention is to provide an improved method and apparatus for cutting and other narrow-path-processing with respect to graphics on sheet materials of various kinds.

These and other objects of the invention will be apparent from the following descriptions and from the drawings.

SUMMARY OF THE INVENTION

The instant invention overcomes the above-noted problems and shortcomings and satisfies the objects of the invention. The invention is an improved method and apparatus for cutting graphics areas from sheets, or other narrow-path-processing with respect to graphics images. Stated more broadly, the invention is an improved method and apparatus for narrow-path-processing with respect to graphics images on sheets, including by cutting, creasing, scoring or the like around such images. Of particular note is that the instant invention brings high speed and improved efficiency, including eliminating certain manual intervention, to the precision cutting of graphics images from sheets bearing such images, including in situations in which there has been distortion of various kinds in the sheets, including two-dimensional distortion.

The method of this invention is stated with respect to cutting graphics areas from a sheet of material bearing such graphics area and a plurality of registration marks in predetermined positions with respect to the graphics area. The plurality of marks includes a subset of the marks as initial-position/orientation-determining marks, printed on no more than one side of the graphics area.

The method is of the type which includes (a) placing the sheet on a sheet-receiving surface, (b) sensing the subset in the field of view of a main sensor to determine the position and orientation of the sheet and approximate positions of the plurality of marks, (c) sensing the precise positions of the marks, and (d) cutting the graphics area from the sheet in response to the precise positions of the marks with respect to the graphics area. The invention involves the addition of steps which enable the process to proceed when the subset is not in an expected location on the sheet-receiving surface. These steps include automatically determining the coordinate region of the subset on the sheet-receiving surface and, in response to such determining step, automatically repositioning the main sensor to the coordinate region such that the subset is within the field of view of the main sensor. This method allows the sensing of the registration marks to occur rapidly with a minimum of manual intervention and cutting (or other narrow-path-processing) to occur precisely, whether or not two-dimensional distortion of the sheet is present prior to cutting.

The coordinate region of the subset on the sheet-receiving surface is the area thereof which, when contained within the field of view of the main sensor, enables main-sensor sensing of the subset with precision sufficient to determine the position and orientation of the sheet of material on the sheet-receiving surface such that the various registration marks can be automatically found to enable subsequent precision sensing thereof.

In certain preferred embodiments of the invention, automatically determining the coordinate region of the subset includes moving the main sensor in a predetermined pattern surrounding the expected location of the subset and stopping the movement of the main sensor when the coordinate region of the subset is located within the field of view of the main sensor. In one such embodiment, movement of the main sensor is in the plane of the sheet-receiving surface. In another such embodiment, moving the main sensor includes rotating the main sensor such that the field of view changes.

In certain embodiments of the invention, the automatic determining step includes enlarging the field of view of the main sensor, thereby locating the coordinate region of the subset within an enlarged field of view. The main sensor is then repositioned, including shrinking the field of view of the main sensor, such that the subset is within the field of view of the main sensor. In one such embodiment, enlarging and shrinking the field of view of the main sensor is performed by zooming a lens of the main sensor. In another such embodiment, the enlarging and shrinking steps are performed by increasing and decreasing respectively the distance between the main sensor and the sheet-receiving surface.

In another embodiment of the invention, automatically determining the location of the coordinate region of the subset involves locating the coordinate region of the subset within the field of view of a secondary sensor.

In certain embodiments of the invention, automatic determination the coordinate region of the subset includes sensing directive indicia on the sheet of material which indicate the coordinate region of the subset, the directive indicia being outside the coordinate region of the subset. Directive indicia may be extra marks printed on the sheet of material, marks which are part of the final graphics product being processed, or edges and/or corners of the sheet of material itself, all of which can be used to indicate the location of the subset. In particular embodiments of the invention, the automatic determining step includes determining from the directive indicia the direction and distance from the expected location to the actual location and repositioning the main sensor by moving it in the determined direction for the determined distance.

The inventive apparatus is a device for cutting a graphics area from a sheet of material bearing such graphics area and a plurality of registration marks in predetermined positions with respect the graphics area. The plurality of registration marks includes a subset of the marks as initial-position/orientation-determining marks, printed on no more than one side of the graphics area. The device includes: a sheet-receiving surface; a main sensor for sensing the subset in the field of view of the main sensor to determine the position and orientation of the sheet and approximate positions of the plurality of marks and for sensing the precise positions of the marks; a cutter operatively connected to the sensor and movable about the sheet-receiving surface, the cutter cutting the graphics area from the sheet of material in response to the precise positions of the marks sensed by the main sensor; and a coordinate region locator which, if the subset is not in an expected location, automatically determines the coordinate region of the subset on the sheet-receiving surface and in response thereto automatically repositions the main sensor to the coordinate region such that the subset is within the field of view of the main sensor.

In highly preferred embodiments of the invention, the coordinate region locator includes a controller with a set of locating instructions for moving the main sensor in a predetermined pattern surrounding the expected location of the subset, and stopping the movement of the main sensor when the coordinate region of the subset is located within the field of view of the main sensor.

In certain preferred embodiments, the coordinate region locator includes a zoom lens on the main sensor and a controller with a set of locating instructions for (a) enlarging the field of view of the main sensor by zooming the lens, (b) locating the coordinate region of the subset within the enlarged field of view, (c) repositioning the main sensor in response to the locating step, and (d) shrinking the field of view of the main sensor by zooming the lens such that the subset is within the field of view of the main sensor.

Another embodiment of the coordinate region locator includes a main-sensor height adjustor and a controller with a set of locating instructions for (a) enlarging the field of view of the main sensor by increasing the distance of the main sensor from the sheet material, (b) locating the coordinate region of the subset within the enlarged field of view, (c) repositioning the main sensor in response to the locating step, and (d) shrinking the field of view of the main sensor by decreasing the distance of the main sensor from the sheet such that the subset is within the field of view of the main sensor.

In certain embodiments of the invention, the coordinate region locator includes a secondary sensor with a field of view larger than the field of view of the main sensor, and a controller with a set of locating instructions for (a) locating the coordinate region of the subset within the field of view of the secondary sensor, and (b) repositioning the main sensor in response to the locating step such that the subset is within the field of view of the main sensor.

In another embodiment of the invention, the coordinate region locator includes directive indicia printed on the sheet of material outside the coordinate region of the subset in predetermined positions and orientations with respect to the subset, and a controller with a set of locating instructions for determining the coordinate region of the subset by sensing the directive indicia, and repositioning the main sensor in response thereto, such that the subset is within the field of view of the main sensor.

DETAILED DESCRIPTION OF PREFERRED EMBODIMENTS

Figure 1:
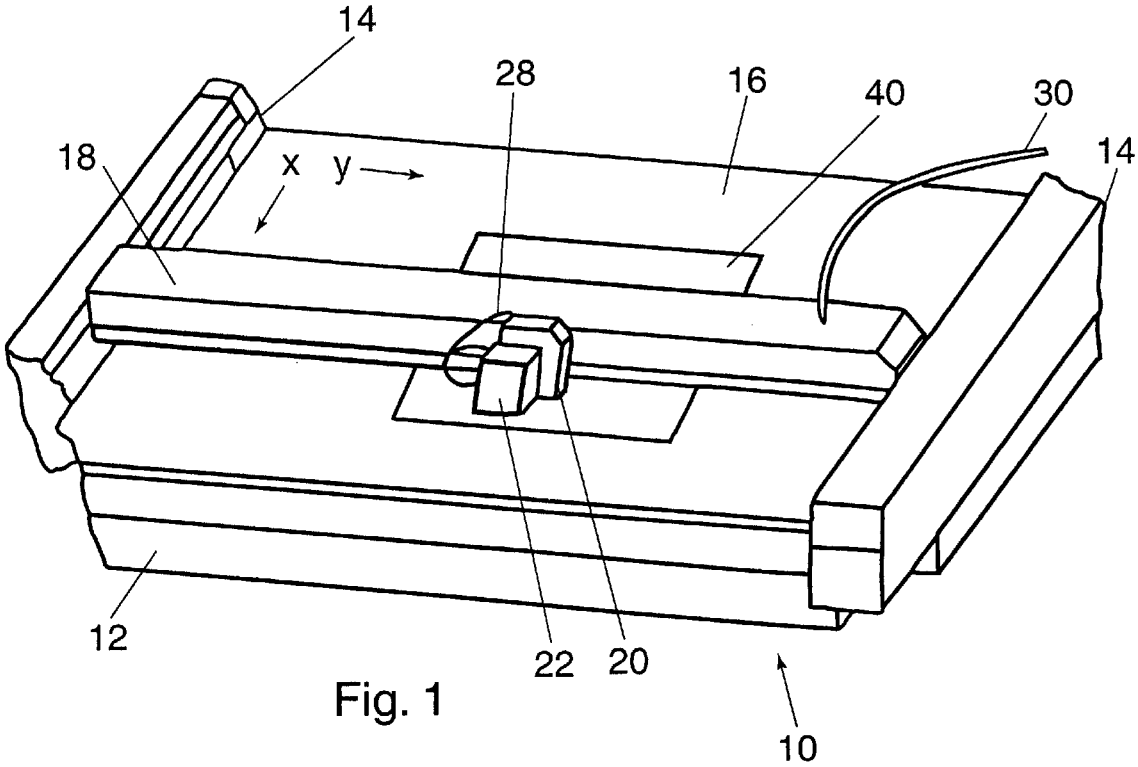
FIG. 1 is a perspective view of an automatically controlled cutting apparatus employing the present invention.

Referring to FIG. 1, a partially cutaway view of a cutting device 10 is shown. Cutting device 10 has a housing 12 which may contain the controller (not shown) and a sheet-receiving surface 16. Cutting device 10, which is shown with a sheet 40 positioned on sheet-receiving surface 16, is also known as a flatbed plotter or cutter in the art, and may be a Zund plotter, manufactured by Zund System Technik HG, or a Wild plotter, to give two examples.

Cutting device 10 includes two longitudinal guide rails 14 mounted on housing 12 and a transverse member 18 suspended between longitudinal guide rails 14. Transverse member 18 is driven along guide rails 14 by a motor (not shown). A cutting tool 20, also driven by a motor (not shown), rides on transverse member 18. Cutting tool 20 has a cutting knife (not shown). Movement of cutting tool 20 over the sheet-receiving surface is performed by transverse member 18 moving back and forth along guide rails 14 and cutting tool 20 moving back and forth along transverse member 18.

A main sensor 22 is shown attached to cutting tool 20, although it is not necessary for it to be attached to it. Main sensor 22 may be an optical detector, such as a CCD camera which is known in the art, responsive to registration marks and other indicia on sheet 40.

Figure 2:
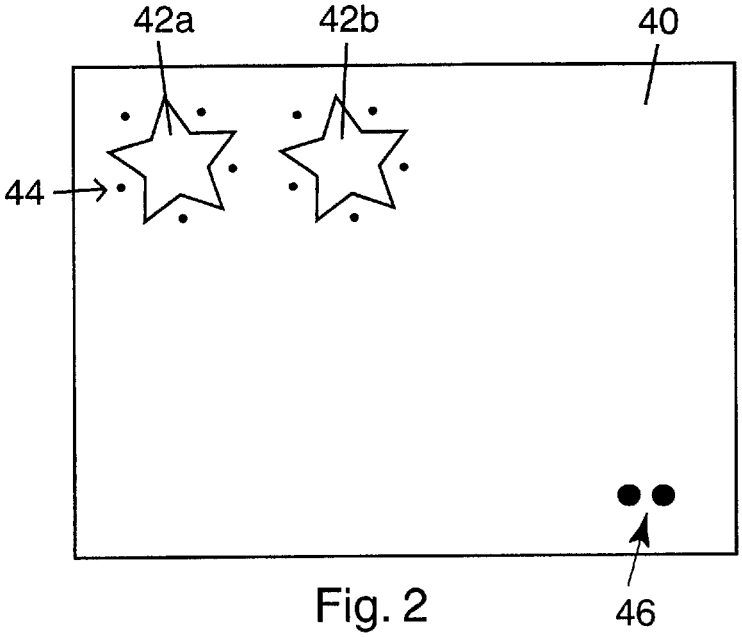
FIG. 2 is a top view of a sheet of sheet material with pre-printed graphics areas and registration marks, including an initial-position/orientation-determining subset of marks.

Referring to FIG. 2, registration marks 44 are pre-printed on sheet 40. Sheet 40 has many registration marks 44 preprinted thereon, including several around each of the graphics areas 42*a* and 42*b* which are intended to be cut from sheet 40. The registration marks include an initial-position/orientation-determining subset 46 of marks which is on only one side of the graphics areas 42*a* and 42*b*. These subset 46 is placed only to one side of graphics areas 42*a* and 42*b* to facilitate rapid determination of the positions of such subset relative to work surface 16. It is possible for there to be more than one subset of unique initial-position/orientation-determining marks, but in such cases only one such subset need be sensed.

Main sensor 22 is connected to the input of the controller, part of the coordinate region locator (not shown as a discrete element) by cables 28 and 30. The controller is also connected to and drives cutting tool 20. The controller receives the input external data and compares it to the format and content of information which it has stored in it. For each graphics area 42*a* and 42*b*, the information stored in the controller is the location of the perimeter of the graphics area relative to the locations of registration marks 44 as printed on sheet 40. Specifically, the controller has information defining the position of the registration marks 44 and the intended cutting paths, information defining the position of the registration marks 44 with respect to initial-position/orientation-determining subset 46 of marks, and information defining the expected location of subset 46 on sheet-receiving surface 16.

After graphics areas 42*a* and 42*b* and registration marks 44 and initial-position/orientation-determining subset 46 of marks have been printed on sheet 40, sheet 40 is placed on sheet-receiving surface 16 at an initial position and orientation. When the controller instructs main sensor 22 to sense subset 46 but subset 46 is not found in the location expected by the controller, the controller instructs main sensor 22 to move in a predetermined pattern.

Figure 3:
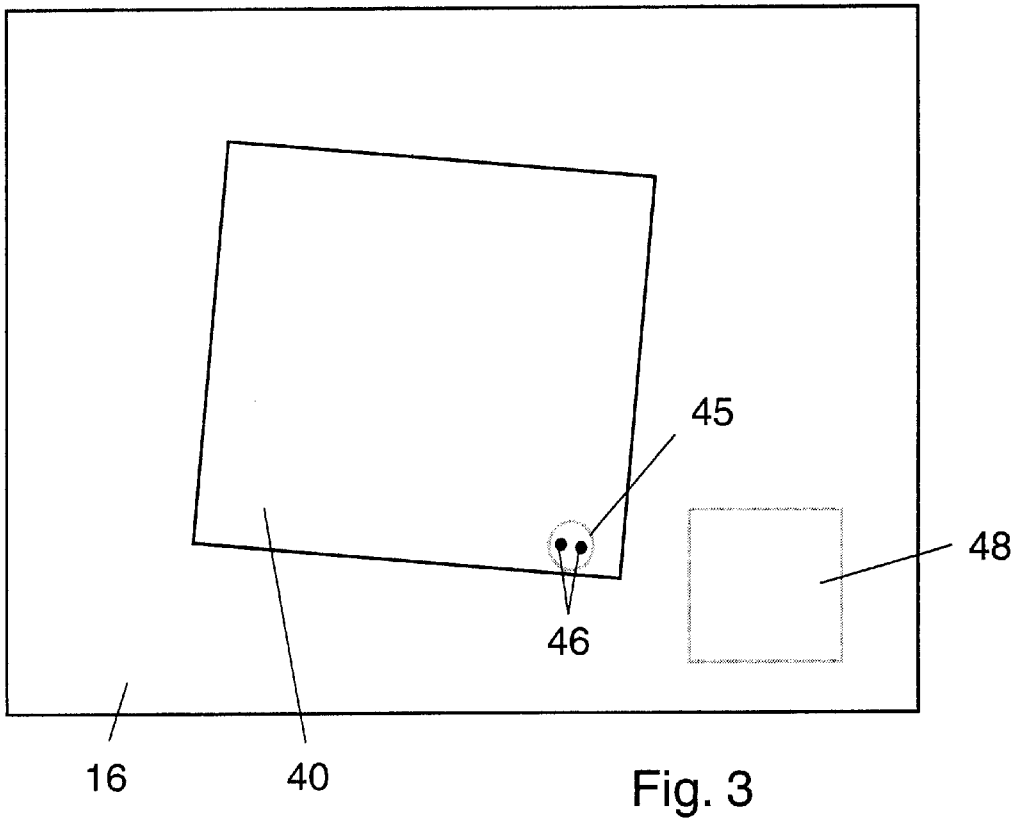
FIG. 3 is a top view of a sheet of material on a sheet-receiving surface, illustrating a coordinate region of the subset and a field of view of a main sensor which does not contain the coordinate region of the subset.

FIG. 3 illustrates sheet 40 placed on sheet-receiving surface 16 such that coordinate region 45 of subset 46 of marks is not within initial field of view 48 of main sensor 22.

Figure 4A:
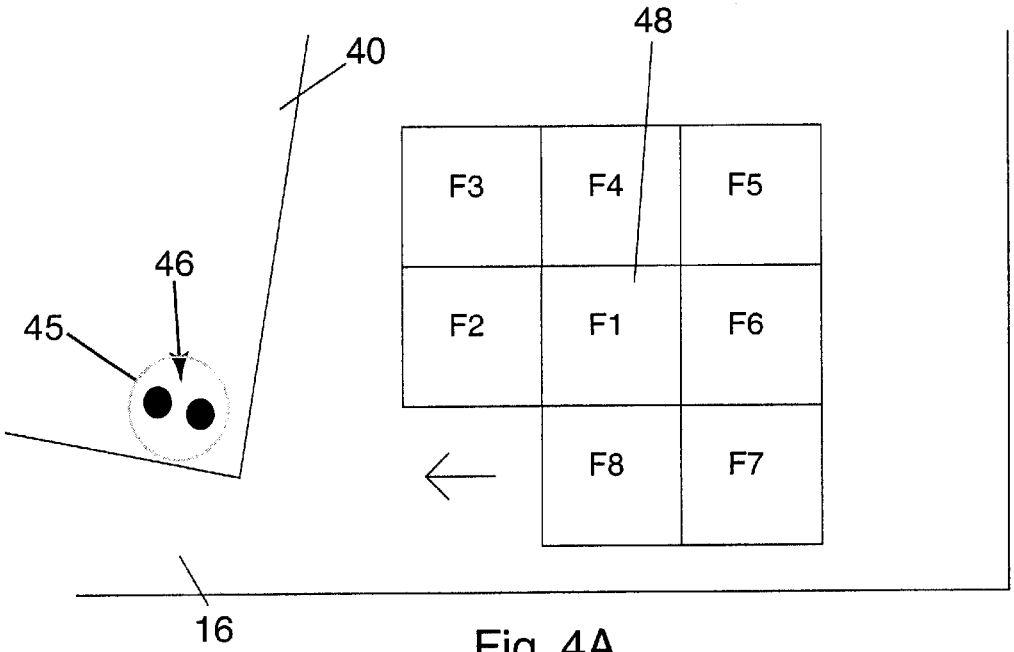
FIG. 4A is a top view of a portion of a sheet-receiving surface, a portion of a sheet of material, and one predetermined pattern of movement of the main sensor, illustrated by consecutive fields of view of the main sensor.
Figure 4B:
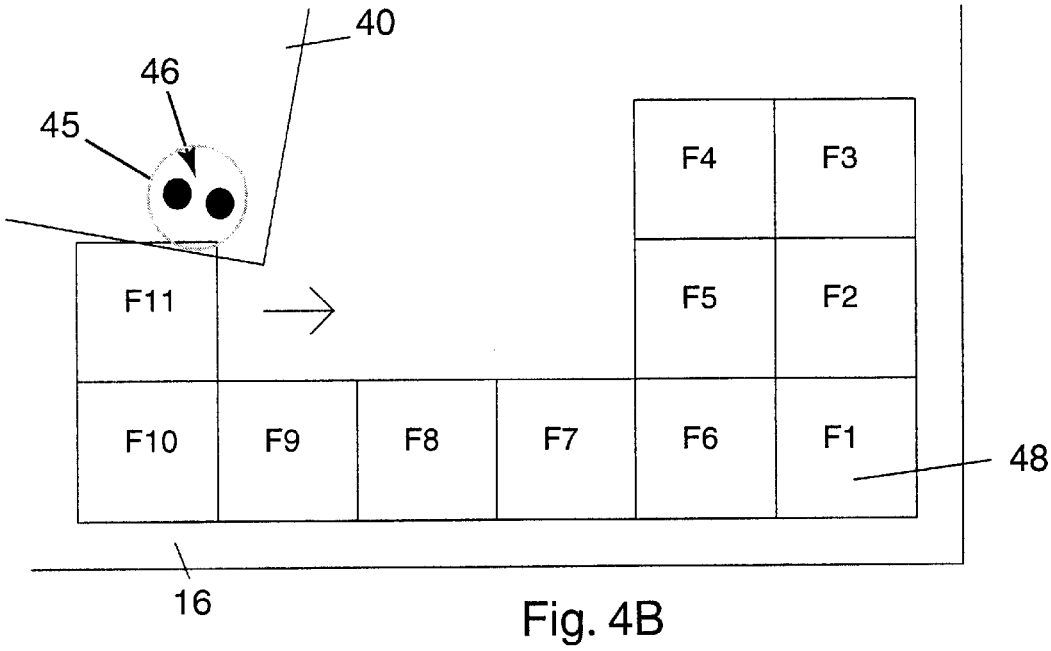
FIG. 4B is a top view of a portion of a sheet-receiving surface, a portion of a sheet of material, and a second predetermined pattern of movement of the main sensor, illustrated by consecutive fields of view of the main sensor.

FIGS. 4A and 4B illustrate two predetermined patterns along which main sensor 22 is directed to move by the controller of the coordinate region locator. In FIGS. 4A and 4B, one corner of sheet-receiving surface 16 is shown, along with one corner of sheet 40 containing subset 46. In each of these figures, movement of main sensor 22 is illustrated by consecutive fields of view F1, F2, F3 . . . , etc., with initial field of view 48 (F1) aligning with the expected location of subset 46. FIG. 4A illustrates a predetermined outwardly-expanding spiral pattern, and FIG. 4B illustrates a predetermined L-shaped pattern. These examples of predetermined patterns are but two of many patterns which can be used in the coordinate region locator to place coordinate region 45 of subset 46 within the field of view of main sensor 22.

Information obtained by sensing subset 46 is then used to determine the position and orientation of sheet 40 on work surface 16. Once the position and orientation of sheet 40 are known, the controller uses the stored information on the relative location of registration marks 44, in conjunction with main sensor 22, to determine the precise positions of registration marks 44.

While FIGS. 4A and 4B illustrate predetermined patterns made of a series of discrete fields of view, the patterns of this invention also contemplate continuous movement and continuous viewing by coordinate region locator.

Figure 5:
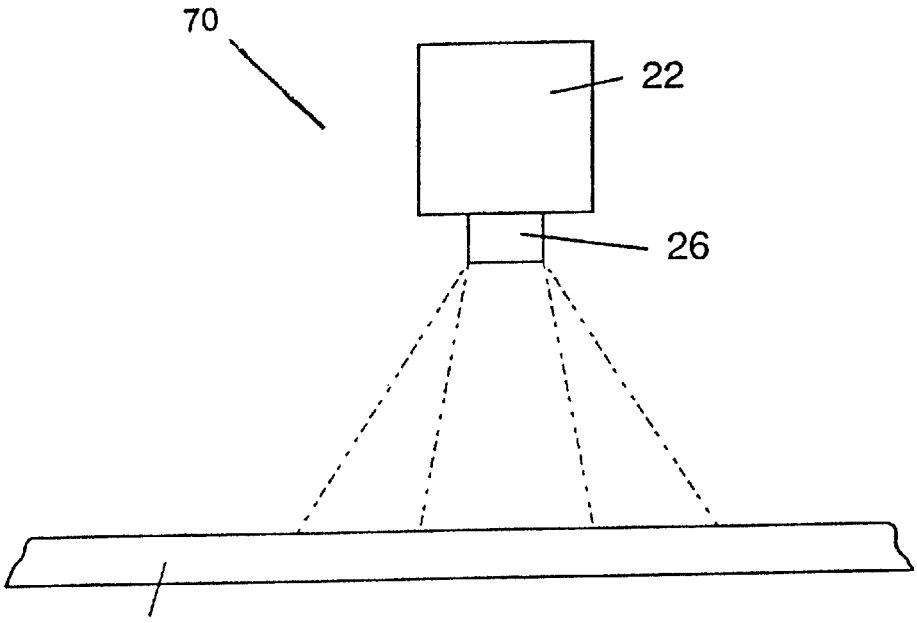
FIG. 5 is a schematic side view of sheet-receiving surface and a main sensor with a zoom lens.

FIG. 5 shows schematically another embodiment of the coordinate region locator 70. Main sensor 22 includes a zoom lens 26 which is used to enlarge the field of view of main sensor 22. When subset 46 is not in an expected location, the controller of the coordinate region locator instructs the zoom lens to zoom out to enlarge the field of view and determines the position of subset 46 in this enlarged field of view. Then, main sensor 22 is repositioned over sheet-receiving surface 16 such that coordinate region 45 of subset 46 is centered within the field of view of main sensor 22, after which main sensor 22 zooms back in, shrinking its field of view in order to allow precise sensing of the marks of subset 46. Two alternative procedures include zooming main sensor 22 back in either before or during such repositioning; regardless of which procedure is programmed, coordinate region 45 of subset 46 will end up within the shrunken field of view of main sensor 22.

Figure 6:
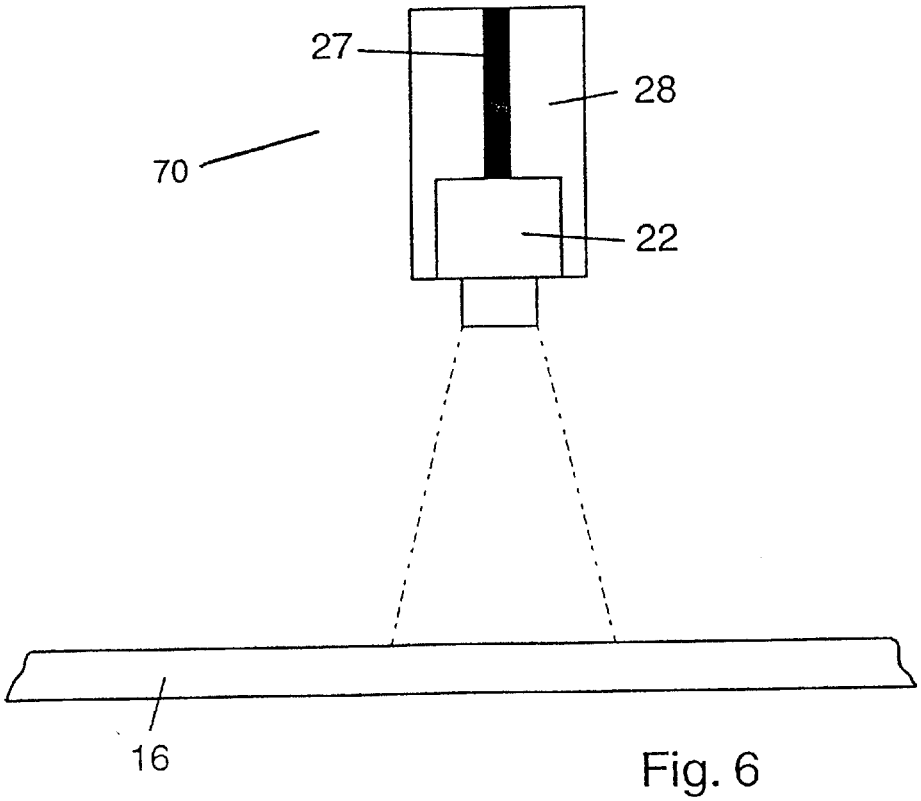
FIG. 6 is a schematic side view of a sheet-receiving surface with a main sensor height adjustor.

FIG. 6 shows schematically yet another embodiment of the coordinate region locator 70. Main sensor 22 is mounted on main-sensor height adjustor 28. Main sensor 22 is moved along track 27 by a motor (not shown) away from and toward sheet-receiving surface 16 to enlarge and shrink respectively the field of view of main sensor 22. When subset 46 is not in an expected location, the controller of the coordinate region locator instructs main sensor 22 to move away from sheet-receiving surface 16, thereby enlarging the field of view of main sensor 22. The coordinate region locator then determines the position of subset 46 and directs the repositioning of main sensor 22 over sheet-receiving surface 16. Then, main sensor 22 is moved back toward sheet-receiving surface 16 to shrink the field of view, such that coordinate region 45 of subset 46 is within the field of view of main sensor 22.

Figure 7:
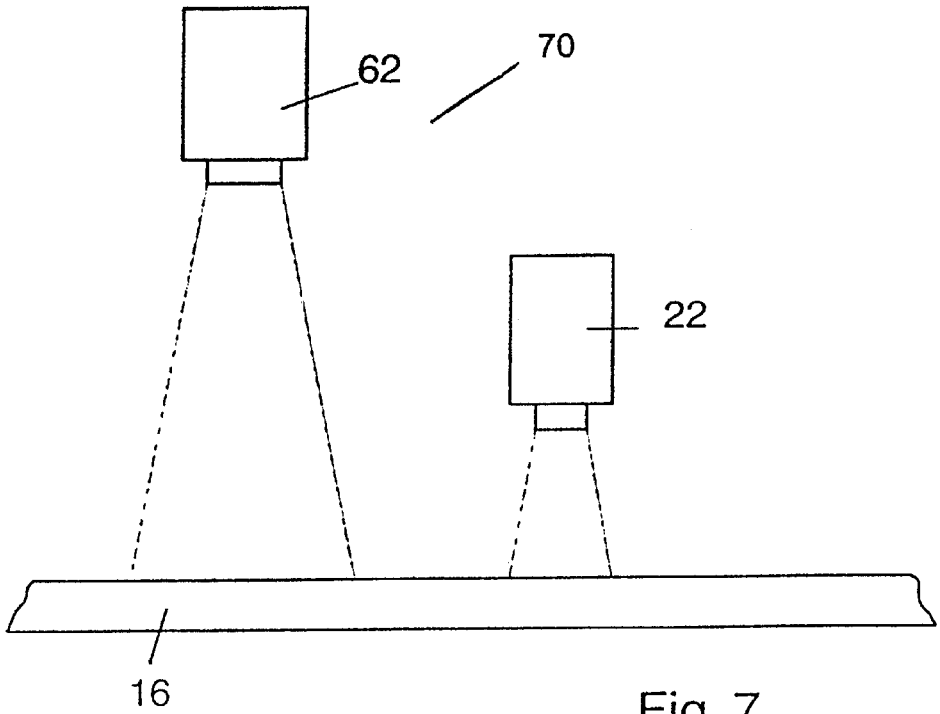
FIG. 7 is a schematic side view of a sheet-receiving surface with a main sensor and a secondary sensor.

FIG. 7 shows schematically a coordinate region locator 70 which includes secondary sensor 62 which has a larger field of view than main sensor 22. Operation of the coordinate region locator in this embodiment is similar to the operation of the embodiment illustrated in FIG. 6, except that secondary sensor 62, the vertical position of which is fixed, takes the place of main sensor 22 in its raised position.

Figure 8:
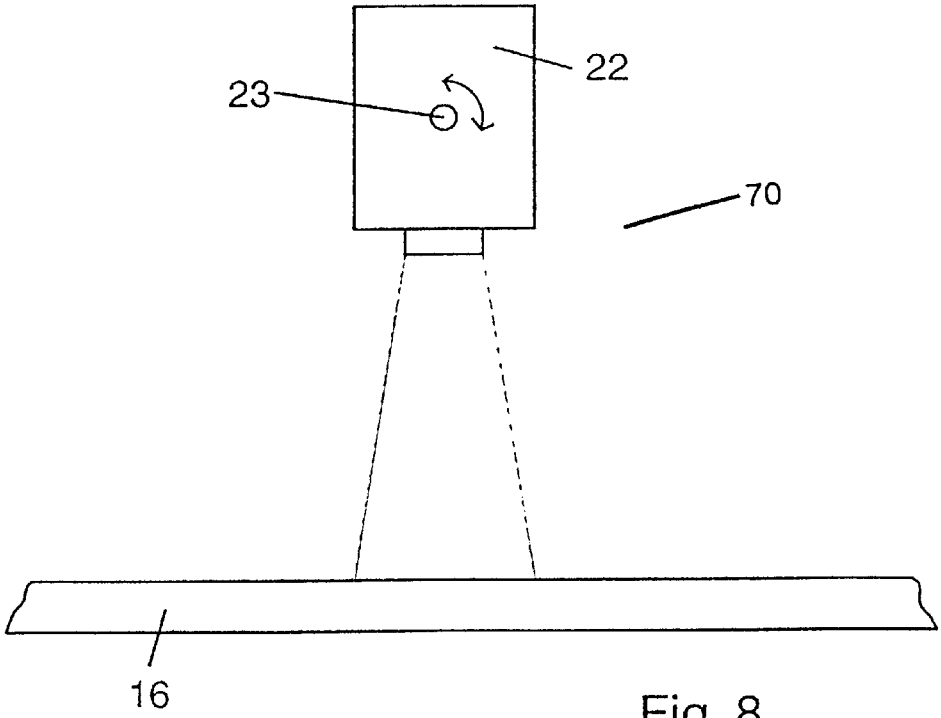
FIG. 8 is a schematic side view of a sheet-receiving surface with a main sensor which rotates to change its field of view.

FIG. 8 illustrates schematically a coordinate region locator 70 which includes rotation around one of two axes parallel to the plane of sheet-receiving surface 16. Rotation about one such axis is illustrated in FIG. 8. When subset 46 is not in an expected location, the controller of the coordinate region locator instructs main sensor 22 to rotate in a manner which changes the field of view of main sensor 22, thereby allowing the coordinate region locator to find coordinate region 45 of subset 46 outside of the initial field of view of main sensor 22. Main sensor 22 then determines the position of coordinate region 45 of subset 46, is repositioned over sheet-receiving surface 16, and rotated back to a normal vertical orientation such that coordinate region 45 of subset 46 is within the field of view of main sensor 22.

Figure 9A:
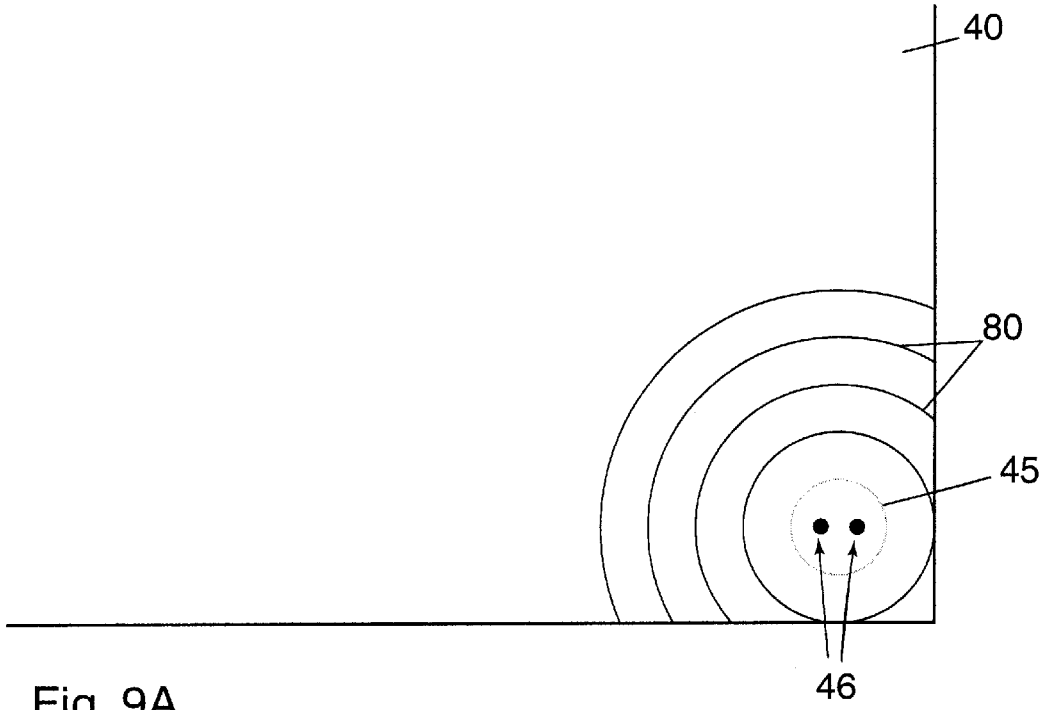
FIG. 9A is a top view of a sheet of material with pre-printed graphics areas, an initial-position/orientation-determining subset, and one type of directive indicia.
Figure 9B:
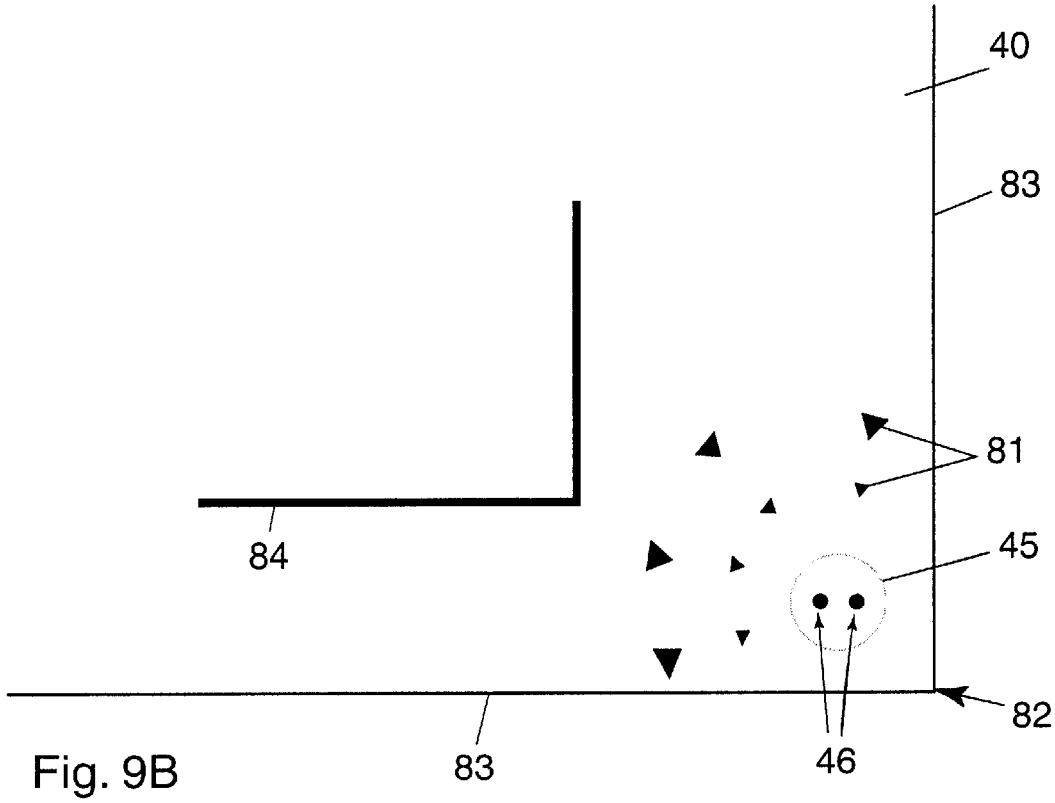
FIG. 9B is a top view of a sheet of material with pre-printed graphics areas, an initial-position/orientation-determining subset, and a second type of directive indicia.

FIGS. 9A and 9B illustrate several different types of directive indicia as part of other embodiments of a coordinate region locator. Shown in FIGS. 9A and 9B are corner portions of sheet-receiving surfaces 16 with corner portions of sheet 40 thereon. The corner portions of sheet 40 include subset 46.

FIG. 9A shows circular directive indicia 80 which surround subset 46 such that the coordinate region locator can determine the location of coordinate region 45 of subset 46 when a portion of circular directive indicia 80 is within the field of view of main sensor 22, the curvature and orientation of circular indicia 80 indicating such location. Such circular directive indicia can be continuous as shown, or can be severely discontinuous as necessary to accommodate the graphics. In a similar manner, the size and orientation of arrow directive indicia 81 surrounding subset 46 in FIG. 9B indicate the location of coordinate region 45 of subset 46.

These directive indicia are but two examples of a much larger number of directive indicia which can be printed outside of coordinate region 45 of subset 46 to indicate the location of coordinate region 45 of subset 46.

FIG. 9B also illustrates edges 83 of sheet 40, a corner 82 of sheet 40, and graphics image portion 84 which can be used in other embodiments of the coordinate region locator. These three types of directive indicia are but examples of alternative directive indicia which can be used by a coordinate region locator to locate coordinate region 45 of subset 46.

As indicated above, the method and apparatus of this invention significantly speed the process of locating precise positions of registration marks 44, and this advantage is made possible regardless of presence or absence of distortion in sheet 40 occurring after the graphics image and registration marks are printed thereon. In operation, sensor 22 is caused to be positioned over a registration mark 44. Sensor 22 finds the mathematical center of a registration mark 44 and defines its position on work surface 16. Two other registration marks 44 are located and their centers are defined in like manner. These data are inputted to the controller where the actual locations of registration marks 44 on sheet 40 are compared to those of the registration marks in the predetermined cutting instructions—which are based on the pre-distortion positions of the graphics image(s) and registration marks 44. The predetermined cutting path is adjusted according to the actual (post-distortion) coordinates of registration marks 44. These comparisons are made interactively throughout the cutting process, making the process a dynamic process. The cutting path is adjusted according to the actual coordinates of the three registration marks 44 closest to a cutting point. When the cutting of an individual graphics area is completed, cutting tool 20 is caused to be lifted and moved to the next graphics area and the process is repeated.

The method and apparatus of this invention have a wide range of applications in a variety of industries. The invention also has application to sheets in the form of curved surfaces, in certain situations. Furthermore, the applicability of the invention is not limited to any particular kind or form of sheet.

While the principles of this invention have been described in connection with specific embodiments, it should be understood clearly that these descriptions are made only by way of example and are not intended to limit the scope of the invention.

What is claimed is:

1. In a method for cutting a graphics area including graphics from a sheet of material bearing such graphics area and a plurality of registration marks in predetermined positions with respect thereto at the time the graphics are applied, a subset of the marks being initial-position/orientation-determining marks on no more than one side of the graphics area, the method being of a type including (a) placing the sheet of material on a sheet-receiving surface, (b) sensing the subset in a field of view of a main sensor to determine a position and orientation of the sheet of material and approximate positions of the plurality of registration marks at the time of cutting, (c) sensing precise positions of the marks, and (d) cutting the graphics area from the sheet of material in response to the precise positions of the marks with respect to the graphics area at that time, the improvement comprising:

if the subset is not in an expected location, automatically determining a coordinate region of the subset on the sheet-receiving surface; and in response to determining the coordinate region of the subset, automatically repositioning the main sensor to the coordinate region such that the subset is within the field of view of the main sensor whereby cutting occurs precisely despite two-dimensional distortion of the sheet of material prior to cutting.

2. In a method for narrow-path-processing with respect to a graphics area on a sheet of material bearing such graphics area and a plurality of registration marks in predetermined positions with respect thereto, a subset of the marks being initial-position/orientation-determining marks on no more than one side of the graphics area, the method being of a type including (a) placing the sheet of material on a sheet-receiving surface, (b) sensing the subset in a field of view of a main sensor to determine a position and orientation of the sheet of material and approximate positions of the plurality of registration marks, (c) sensing precise positions of the marks, and (d) narrow-path-processing with respect to the graphics area on the sheet of material in response to the precise positions of the marks with respect to the graphics area, the improvement comprising:

if the subset is not in an expected location, automatically determining a coordinate region of the subset on the sheet-receiving surface; and in response to determining the coordinate region of the subset, automatically repositioning the main sensor to the coordinate region such that the subset is within the field of view of the main sensor.

3. An apparatus for cutting a graphics area from a sheet of material bearing such graphics area and a plurality of registration marks in predetermined positions with respect thereto, a subset of the marks being initial-position/orientation-determining marks on no more than one side of the graphics area, the apparatus being of a type including (a) a sheet-receiving surface, (b) a main sensor adapted to sense the subset in a field of view of the main sensor to determine a position and orientation of the sheet of material and approximate positions of the plurality of registration marks and to sense precise positions of the marks, and (c) a cutter operatively connected to the sensor and movable about the sheet-receiving surface, the cutter adapted to cut the graphics area from the sheet of material in response to the precise positions of the marks sensed by the main sensor, the improvement comprising a coordinate region locator which includes the main sensor, the coordinate region locator adapted to automatically determine a coordinate region of the subset on the sheet-receiving surface and to automatically reposition the main sensor to the coordinate region such that the subset is within the field of view of the main sensor.

4. The apparatus of 3 wherein the coordinate region locator includes:

a zoom lens on the main sensor; and a controller adapted to (a) enlarge the field of view of the main sensor by zooming the lens, (b) locate the coordinate region of the subset within the enlarged field of view, (c) reposition the main sensor in response to the locating step, and (d) shrink the field of view of the main sensor by zooming the lens such that the subset is within the field of view of the main sensor.

5. The apparatus of claim 3 wherein the coordinate region locator includes:

a main-sensor height adjustor; and a controller adapted to (a) enlarge the field of view of the main sensor by increasing the distance of the main sensor from the sheet of material, (b) locate the coordinate region of the subset within the enlarged field of view, (c) reposition the main sensor in response to the locating step, and (d) shrink the field of view of the main sensor by decreasing the distance of the main sensor from the sheet of material such that the subset is within the field of view of the main sensor.

6. The apparatus of claim 3 wherein the coordinate region locator includes:

a secondary sensor with a field of view larger than the field of view of the main sensor; and a controller adapted to (a) locate the coordinate region of the subset within a field of view of the secondary sensor, and (b) reposition the main sensor after locating the coordinate region of the subset such that the subset is within the field of view of the main sensor.

7. The apparatus of claim 3 wherein directive indicia is printed on the sheet of material outside the coordinate region of the subset in predetermined positions and orientations with respect to the subset; and the coordinate region locator includes a controller adapted to (a) determine the coordinate region of the subset by sensing the directive indicia, and (b) reposition the main sensor, such that the subset is within the field of view of the main sensor.

8. The apparatus of claim 3 wherein the coordinate region locator includes a controller adapted to (a) move the main sensor in a predetermined pattern surrounding the expected location of the subset, and (b) stop the movement of the main sensor when the coordinate region of the subset is located within the field of view of the main sensor.

9. In a method for cutting a graphics area from a sheet of material bearing such graphics area and a plurality of registration marks in predetermined positions with respect thereto, a subset of the marks being initial-position/orientation-determining marks on no more than one side of the graphics area, the method being of a type including (a) placing the sheet of material on a sheet-receiving surface, (b) sensing the subset in a field of view of a main sensor to determine a position and orientation of the sheet of material and approximate positions of the plurality of registration marks, (c) sensing precise positions of the marks, and (d) cutting the graphics area from the sheet of material in response to the precise positions of the marks with respect to the graphics area, the improvement comprising:

if the subset is not in an expected location, automatically determining a coordinate region of the subset on the sheet-receiving surface; and in response to determining the coordinate region of the subset, automatically repositioning the main sensor to the coordinate region such that the subset is within the field of view of the main sensor.

10. The method of claim 9 wherein the automatic determining step includes locating the coordinate region of the subset within a field of view of a secondary sensor.

11. The method of claim 9 wherein automatically determining the coordinate region of the subset includes sensing directive indicia on the sheet of material which indicate the coordinate region of the subset, the directive indicia being outside the coordinate region of the subset.

12. The method of claim 9 wherein:

the automatic determining step includes determining (a) the direction from the expected location to the actual location and (b) the distance between the expected location and the actual location; and the repositioning step is movement in the determined direction for the determined distance.

13. The method of claim 9 wherein automatically determining the coordinate region of the subset includes:

moving the main sensor in a predetermined pattern surrounding the expected location of the subset; and stopping the movement of the main sensor when the coordinate region of the subset is located within the field of view of the main sensor.

14. The method of claim 13 wherein the moving step includes rotating the main sensor such that the field of view changes.

15. The method of claim 1 wherein:

the automatic determining step includes enlarging the field of view of the main sensor and locating the coordinate region of the subset within the enlarged field of view; and the automatic repositioning includes shrinking the field of view of the main sensor such that the subset is within the field of view of the main sensor.

16. The method of claim 15 wherein enlarging and shrinking the field of view of the main sensor includes zooming a lens of the main sensor.

17. The method of claim 15 wherein:

the enlarging step includes increasing the distance between the main sensor and the sheet of material; and the shrinking step includes decreasing the distance between the main sensor and the sheet of material.

* * * * *

US006619168C1

(12) INTER PARTES REEXAMINATION CERTIFICATE (498th)

United States Patent
Alsten et al.

(10) Number: US 6,619,168 C1
(45) Certificate Issued: Dec. 20, 2012

(54) METHOD AND APPARATUS FOR AUTOMATIC PRECISION CUTTING OF GRAPHICS AREAS FROM SHEETS

(75) Inventors: Peter Alsten, Racine, WI (US); Geo Andersen, Aabyhoej (DK)

(73) Assignee: Mikkelsen Graphic Engineering, Lake Geneva, WI (US)

Reexamination Request:
No. 95/001,355, May 26, 2010

Reexamination Certificate for:

| | |
|---|---|
| Patent No.: | **6,619,168** |
| Issued: | **Sep. 16, 2003** |
| Appl. No.: | **09/951,167** |
| Filed: | **Sep. 13, 2001** |

Related U.S. Application Data

(63) Continuation-in-part of application No. 09/827,000, filed on Apr. 5, 2001.

(51) Int. Cl.
*B26D 5/00* (2006.01)

(52) U.S. Cl. ..... 83/13; 83/39; 83/52; 83/75.5; 83/76.8; 83/364; 83/365; 83/368; 83/371; 83/940; 700/134; 700/171; 347/157

(58) Field of Classification Search ..... None
See application file for complete search history.

(56) References Cited

To view the complete listing of prior art documents cited during the proceeding for Reexamination Control Number 95/001,355, please refer to the USPTO's public Patent Application Information Retrieval (PAIR) system under the Display References tab.

*Primary Examiner* — Glenn K. Dawson

(57) ABSTRACT

An improved method and apparatus for automatic cutting of graphics area(s) from a sheet of material which includes such graphics area(s), the graphics areas having a plurality of registration marks in predetermined positions with respect thereto and including a subset of the marks on no more than one side of the graphics area which are initial-position/orientation-determining marks. The method involves placing the sheet on a sheet-receiving surface, attempting to sense the subset in the field of view of a main sensor, and, when the subset is not in an expected location, automatically determining the coordinate region of the subset on the sheet-receiving surface and automatically repositioning the main sensor to the coordinate region such that the subset is within the field of view of the main sensor. Then the position and orientation of the sheet and approximate positions of the plurality of marks are determined based on sensing the subset, and thereafter their precise positions are sensed to guide cutting operations.

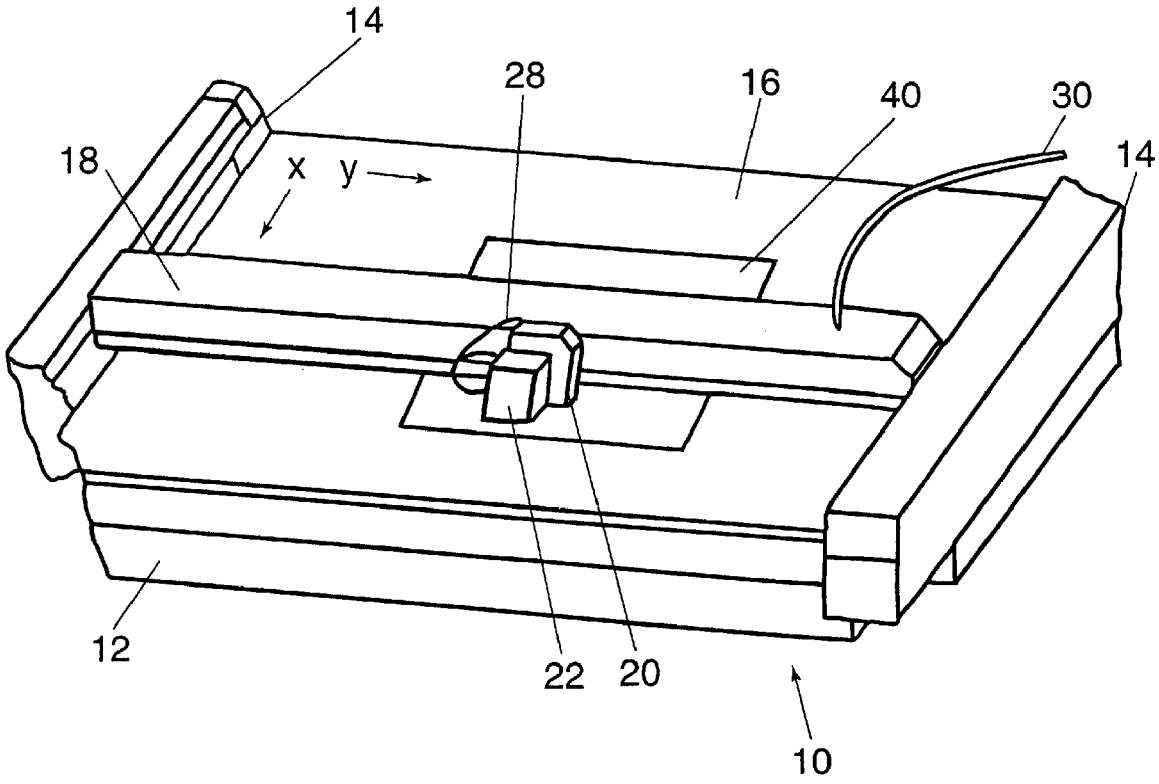

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 1-3, 8, 9, 12 and 13 is confirmed.

Claims 4-7, 10, 11 and 14-17 were not reexamined.

* * * * *